US010526824B2

(12) United States Patent
Farias et al.

(10) Patent No.: US 10,526,824 B2
(45) Date of Patent: Jan. 7, 2020

(54) INTERCONNECTED LOCK WITH ADJUSTABLE DEADBOLT TO LATCHBOLT SPACING

(71) Applicant: SARGENT MANUFACTURING COMPANY, New Haven, CT (US)

(72) Inventors: Pavel Farias, Guadalajara (MX); Gregg Krehel, Newtown, CT (US)

(73) Assignee: SARGENT MANUFACTURING COMPANY, New Haven, CT (US)

( * ) Notice: Subject to any disclaimer, the term of this patent is extended or adjusted under 35 U.S.C. 154(b) by 792 days.

(21) Appl. No.: 14/908,623

(22) PCT Filed: Oct. 10, 2014

(86) PCT No.: PCT/US2014/060007

§ 371 (c)(1),
(2) Date: Jan. 29, 2016

(87) PCT Pub. No.: WO2015/057503

PCT Pub. Date: Apr. 23, 2015

(65) Prior Publication Data

US 2016/0168888 A1 Jun. 16, 2016

Related U.S. Application Data

(60) Provisional application No. 61/890,372, filed on Oct. 14, 2013.

(51) Int. Cl.
*E05C 3/14* (2006.01)
*E05B 53/00* (2006.01)
(Continued)

(52) U.S. Cl.
CPC ..... *E05C 3/145* (2013.01); *E05B 1/003* (2013.01); *E05B 15/02* (2013.01); *E05B 53/00* (2013.01);
(Continued)

(58) Field of Classification Search
CPC ..... E05B 1/003; E05B 15/02; E05B 53/00; E05B 63/0056; E05C 3/145; E05C 19/00;
(Continued)

(56) References Cited

U.S. PATENT DOCUMENTS 4,129,019 A * 12/1978 Urdal ..... E05B 59/00 70/107
4,156,541 A * 5/1979 Babb, Jr. ..... E05C 9/025 292/21

(Continued)

*Primary Examiner* — Kristina R Fulton
*Assistant Examiner* — Faria F Ahmad
(74) *Attorney, Agent, or Firm* — DeLio Peterson & Curcio LLC; Thomas E. Ciesco

(57) ABSTRACT

An interconnected lock has adjustable offset spacing between latchbolt and deadbolt lock mechanisms, and a sliding pusher mechanism therebetween. The pusher mechanism is operable upon operation of an interior actuator to bear against the deadbolt lock mechanism and move the deadbolt along the second axis from the latched to the unlatched position at the same time that the operation of the interior actuator moves the latchbolt along the first axis from the latched to the unlatched position. The pusher mechanism includes an arm that bears against the deadbolt lock mechanism and may be retracted and extended between a first length and a second, longer length when changing offset spacing between the deadbolt and latchbolt. The arm is extendable from the first length to the second length without adding or removing any components thereof.

21 Claims, 6 Drawing Sheets

(51) Int. Cl.

| | |
|---|---|
| ***E05B 63/00*** | (2006.01) |
| ***E05B 15/02*** | (2006.01) |
| ***E05B 1/00*** | (2006.01) |
| ***E05C 19/00*** | (2006.01) |

(52) U.S. Cl.
CPC ..... *E05B 63/0056* (2013.01); *E05C 19/00* (2013.01); *Y10T 292/0857* (2015.04); *Y10T 292/82* (2015.04); *Y10T 292/85* (2015.04)

(58) Field of Classification Search
CPC .. Y10T 292/82; Y10T 292/85; Y10T 292/085
USPC ..... 292/347, 348, DIG. 60, 52; 70/107–111, 70/461
See application file for complete search history.

(56) References Cited

U.S. PATENT DOCUMENTS 4,276,760 A * 7/1981 Nolin ..... E05B 59/00 292/21
4,809,526 A * 3/1989 Shen ..... E05B 59/00 292/21
4,838,053 A * 6/1989 Shen ..... E05B 59/00 292/336.3
4,925,222 A * 5/1990 Loock ..... E05B 3/065 292/336.3
4,979,767 A * 12/1990 Lin ..... E05B 59/00 292/336.3
4,982,986 A * 1/1991 Gressett, Jr. ..... E05B 3/065 292/165
5,205,596 A * 4/1993 Ralph ..... E05B 3/065 292/224
5,325,687 A * 7/1994 Lin ..... E05B 59/00 292/36
5,513,505 A 5/1996 Dancs
5,713,612 A 2/1998 Kajuch
5,881,585 A * 3/1999 Kang ..... E05B 59/00 292/21
5,881,586 A * 3/1999 Shen ..... E05B 53/00 292/34
6,170,305 B1 * 1/2001 Shen ..... E05B 59/00 70/107
6,585,302 B2 * 7/2003 Lin ..... E05B 47/0012 292/142
7,343,762 B1 * 3/2008 East ..... E05B 13/108 292/36
7,364,212 B1 * 4/2008 Fan ..... E05B 1/003 292/33
8,267,442 B2 * 9/2012 Tien ..... E05B 3/00 292/138
8,826,705 B2 * 9/2014 Tien ..... E05B 55/06 292/336.3
9,145,709 B2 * 9/2015 Tien ..... E05B 63/0056
2005/0262906 A1 * 12/2005 Romero ..... E05B 9/02 70/107
2006/0053846 A1 * 3/2006 Huang ..... E05B 15/02 70/107
2007/0137267 A1 * 6/2007 Pilatowicz ..... E05B 47/068 70/107
2008/0127686 A1 * 6/2008 Hwang ..... E05B 13/005 70/107
2011/0314878 A1 12/2011 Roth et al.

* cited by examiner

INTERCONNECTED LOCK WITH ADJUSTABLE DEADBOLT TO LATCHBOLT SPACING

BACKGROUND OF THE INVENTION

1. Field of the Invention

The present invention relates to interconnected locks, i.e., locks in which the outside of the door has a latchbolt lock mechanism on the bottom and a separate deadbolt lock mechanism on the top, but on the inside the mechanisms are interconnected so that rotating the inner handle automatically retracts both the latchbolt and the deadbolt, without having to separately unlock the two.

2. Description of Related Art

Many local codes dictate when a deadbolt is in use the lockset must be an interconnected type lockset to allow simultaneous retraction of both the latchbolt and the deadbolt during egress from the inside of the door, i.e., the inside of the house or apartment, or the side of the door for which security is otherwise desired. Existing interconnect products have a fixed center to center distance measured from the center of rotation of the lever handle, where the latchbolt is positioned, to the centerline of the deadbolt. This fixed dimension of latchbolt/deadbolt axis spacing, or offset distance, is typically either 4 in. (102 mm) or 5.5 in. (140 mm) center to center. For new construction projects consumers can specify door preparation so the offset center-to center distance is not so much of an issue. There is a benefit to offering an adjustable interconnected lock for consumers on renovation and retro fit projects where the door is usually not replaced. There is typically a mix in the market place of 4 in. (102 mm) and 5.5 in. (140 mm) door preparations, but in interconnect markets the predominant door preparation is 4 in. (102 mm) as most competitive interconnects are 4 in. (102 mm). In non-interconnect markets the 5.5 in. (140 mm) distance is often used with a deadbolt and passage. The biggest driver for covering both preparations is to comply with the International Building Code (IBC). As more states adopt the IBC interconnected locks will increase in use as single handle motion egress is required. The ability to retrofit both offset distances without re-prepping or buying new doors would be advantageous.

An existing system for accommodating both 4 in. (102 mm) and 5.5 in. (140 mm) latchbolt-deadbolt offset spacing is disclosed in U.S. Pat. No. 8,434,335. However, this system requires the installer to partially disassemble the interior components of the door latch and deadbolt assembly to remove or add an insert slide when switching between the 4 in. (102 mm) and 5.5 in. (140 mm) latchbolt/deadbolt offset spacing. It would be advantageous to be able to switch between different latchbolt-deadbolt offset spacings without any disassembly of the assembly that operates the deadbolt, either partially or completely, and without adding or removing any components thereof. This would eliminate the potential of losing parts during the spacing adjustment. It would also be advantageous to accomplish the switch between different latchbolt/deadbolt spacings without the need for using any tools, which would simplify such changeover.

SUMMARY OF THE INVENTION

Bearing in mind the problems and deficiencies of the prior art, it is therefore an object of the present invention to provide an interconnected lock that is able to switch between different latchbolt-deadbolt offset spacings without any disassembly of the assembly that operates the deadbolt, either partially or completely.

It is another object of the present invention to provide an interconnected lock that is able to switch between different latchbolt-deadbolt offset spacings without adding or removing any components thereof.

A further object of the invention is to provide an interconnected lock that is able to switch between different latchbolt-deadbolt offset spacings without the potential of losing parts during the spacing adjustment.

It is yet another object of the present invention to provide an interconnected lock that is able to accomplish the switch between different latchbolt/deadbolt spacing without the need for using any tools.

Still other objects and advantages of the invention will in part be obvious and will in part be apparent from the specification.

The above and other objects, which will be apparent to those skilled in the art, are achieved in the present invention which is directed in one aspect to an interconnected lock for use on a door, where the lock has adjustable offset spacing between a deadbolt and latchbolt. The interconnected lock includes a latchbolt mechanism mountable in a first bore through a door. The latchbolt lock mechanism includes a latchbolt and an interior actuator operable to move the latchbolt between latched and unlatched positions along a first axis. The interconnected lock further includes a deadbolt lock mechanism mountable in a second bore through a door, where the second bore is spaced from the first bore. The deadbolt lock mechanism includes a deadbolt moveable by the deadbolt lock mechanism along a second axis between latched and unlatched positions, with distance between the latchbolt first axis and the deadbolt second axis being the offset spacing. The interconnected lock also includes a sliding pusher mechanism between the latchbolt mechanism and the deadbolt lock mechanism. The pusher mechanism is operable upon operation of the interior actuator to bear against the deadbolt lock mechanism and move the deadbolt along the second axis from the latched to the unlatched position at the same time that the operation of the interior actuator moves the latchbolt along the first axis from the latched to the unlatched position. The pusher mechanism is extendable between a first length and a second, longer length when adjusting spacing between the first and second axes to change offset spacing between the deadbolt and latchbolt between a first distance and a second, longer distance.

The pusher mechanism may include at least one arm and the deadbolt lock mechanism may include a deadbolt cam, wherein the pusher arm bears against the deadbolt cam to rotate the cam and move the deadbolt from the latched to the unlatched position. The pusher mechanism arm may be connected by a hinge to the pusher mechanism, with the arm being movable about the hinge between a retracted position and an extended position. The arm may be movable about the hinge between a retracted position folded against the pusher mechanism and an extended position away from the pusher mechanism. The hinge may include a detent to hold the arm in either the retracted position or the extended position. The interconnected lock may include a pair of the arms, with each connected by a hinge to the pusher mechanism and movable about the hinge between the retracted position and extended positions.

The arm pusher mechanism may include a flange or slot. When the arm is in the folded position, the flange or slot contacts a slot or flange in the pusher mechanism to maintain position of the at least one arm during movement of the pusher mechanism. The lock may include a plate covering the pusher mechanism, and the arm may include a tab extending toward the plate when the at least one arm is in the extended position. The tab is slideable along the plate to prevent movement of the at least one arm away from the extended position during movement of the pusher mechanism.

The latchbolt mechanism may include an actuator cam operable by the interior actuator to slide the pusher mechanism and at least one arm against the deadbolt cam. The pusher mechanism may be extended from the first length to a second, longer length without any disassembly of the pusher mechanism, without adding or removing any components thereof, and/or without any use of tools.

The present invention is directed in another aspect to an interconnected lock having adjustable offset spacing between a deadbolt and latchbolt and which includes a latchbolt mechanism including a latchbolt and an interior actuator operable to move the latchbolt between latched and unlatched positions along a first axis, and a deadbolt lock mechanism spaced from the latchbolt mechanism and including a deadbolt moveable by the deadbolt lock mechanism along a second axis between latched and unlatched positions, wherein the distance between the latchbolt first axis and the deadbolt second axis being the offset spacing. The lock may further include a sliding pusher mechanism between the latchbolt mechanism and the deadbolt lock mechanism. The pusher mechanism is operable upon operation of the interior actuator to bear against the deadbolt lock mechanism and move the deadbolt along the second axis from the latched to the unlatched position at the same time that the operation of the interior actuator moves the latchbolt along the first axis from the latched to the unlatched position. The pusher mechanism may include an arm that may bear against the deadbolt lock mechanism and may be retracted and extended between a first length and a second, longer length when adjusting spacing between the first and second axes to change offset spacing between the deadbolt and latchbolt between a first distance and a second, longer distance. The arm is extendable from the first length to the second length without adding or removing any components thereof.

In a related aspect, the present invention is directed to a method of adjusting offset spacing between a deadbolt and latchbolt in interconnected lock for use on a door. The method initially comprising providing an interconnected lock of the types described above. The method further includes adjusting the spacing between the latchbolt first axis and the deadbolt second axis to change the offset spacing between the deadbolt and latchbolt to a shorter or longer offset spacing distance. If changing to a shorter offset spacing distance, the method includes reducing extension of the pusher mechanism to the first length. If changing to a longer offset spacing distance, the method includes extending the pusher mechanism to the second length. The reduction or extension of the length of the pusher mechanism is accomplished without adding or removing any components thereof.

The pusher mechanism may include at least one arm, and reducing extension of the pusher mechanism to the first length or extending the pusher mechanism to the second length is by moving the arm. The pusher mechanism may include at least one arm connected by a hinge to the pusher mechanism. Reducing extension of the pusher mechanism to the first length is by moving the arm about the hinge to a retracted position and extending the pusher mechanism to the second length is by moving the arm to an extended position. The at least one arm may be movable about the hinge between the retracted position folded against the pusher mechanism and the extended position away from the pusher mechanism.

The hinge may include a detent. Reducing extension of the pusher mechanism to the first length or extending the pusher mechanism to the second length may engage the detent to hold the at least one arm in either the retracted position or the extended position. The arm may include a flange or slot. When the at least one arm is in the folded position the flange or slot contacts a slot or flange in the pusher mechanism to maintain position of the at least one arm during movement of the pusher mechanism. The lock may further include a plate covering the pusher mechanism, and the arm may further include a tab extending toward the plate when the at least one arm is in the extended position. The tab is slideable along the plate to prevent movement of the at least one arm away from the extended position during movement of the pusher mechanism. The reduction or extension of the length of the pusher mechanism may be accomplished without any disassembly of the pusher mechanism.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

In describing the preferred embodiment of the present invention, reference will be made herein to FIGS. 1-20 of the drawings in which like numerals refer to like features of the invention.

Figure 1B:
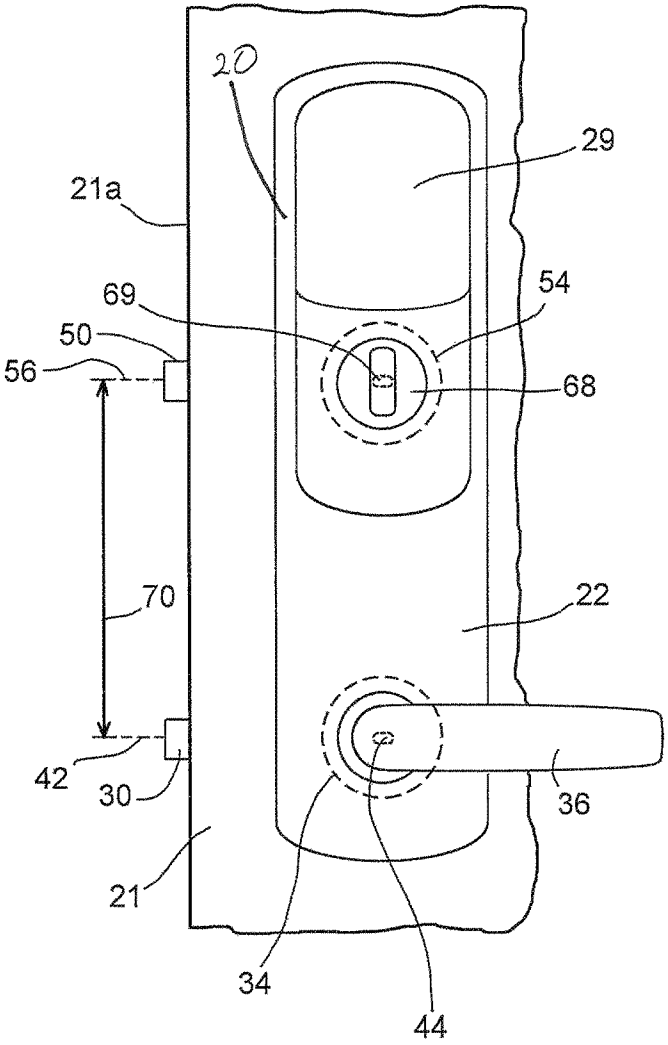
FIGS. 1*a* and 1*b* are front elevational views of an embodiment of the lock assembly of the present invention mounted on the inside of a door showing different offset spacings between the latchbolt and deadbolt.
Figure 1A:
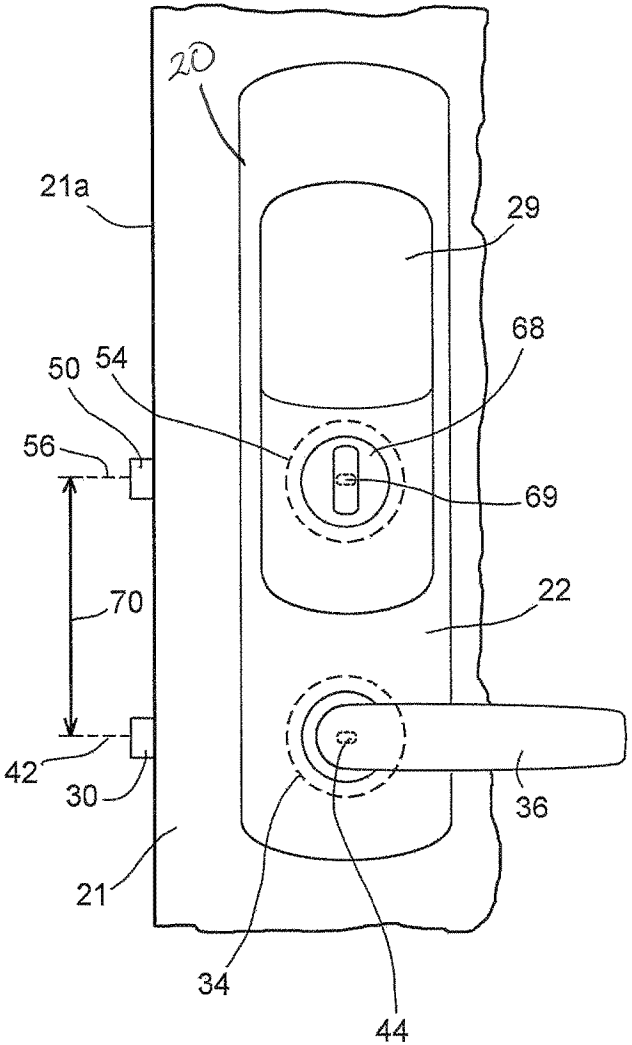
Figure 2:
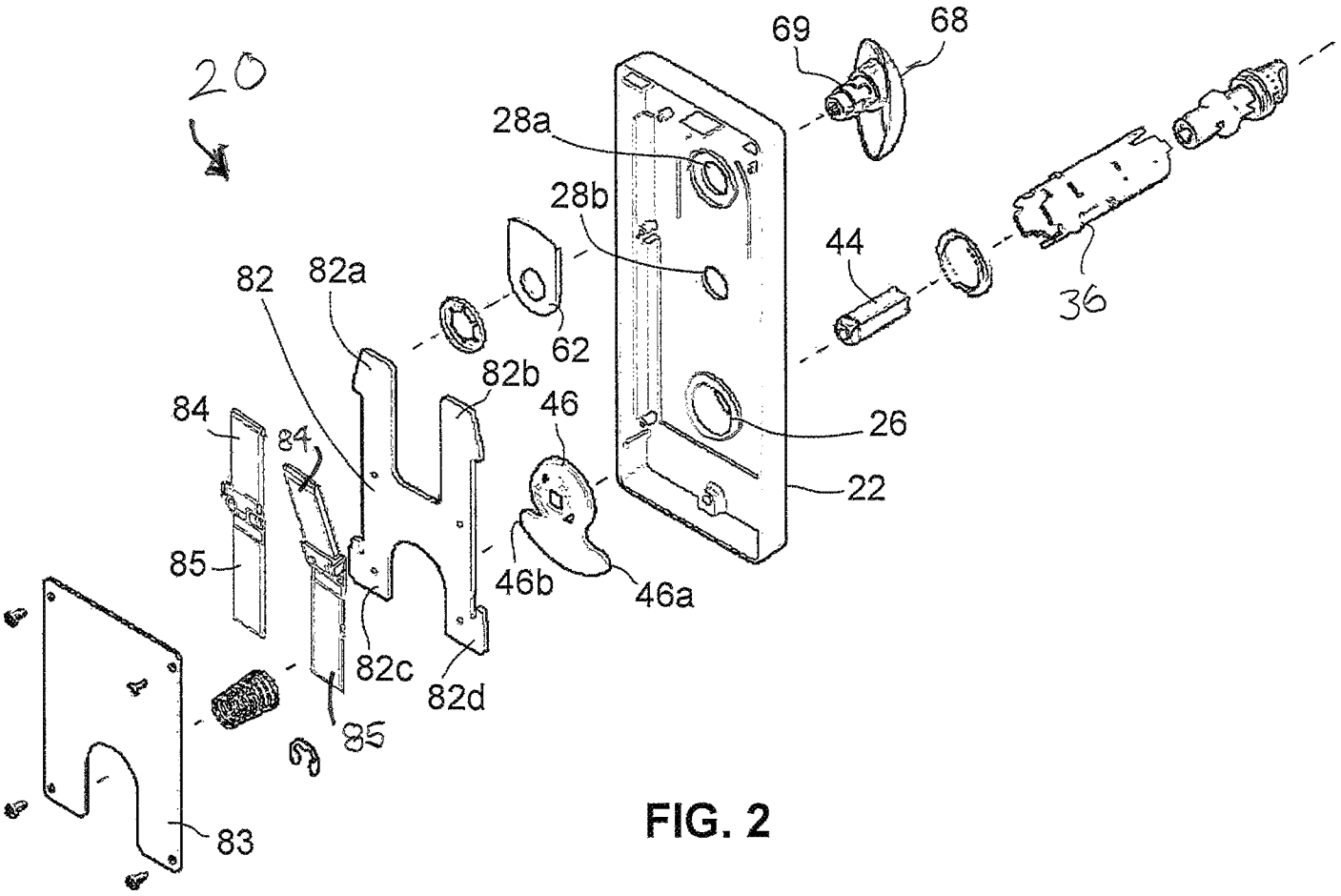
FIG. 2 is an exploded perspective view of a portion of the lock assembly of FIGS. 1*a* and 1*b*, as seen from the rear, in the greater offset spacing position.
Figure 3:
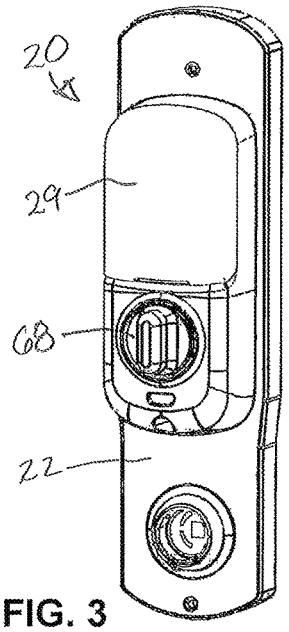
FIG. 3 is a perspective view of the front of the lock assembly of FIG. 1*a* in the closer offset spacing position.
Figure 5:
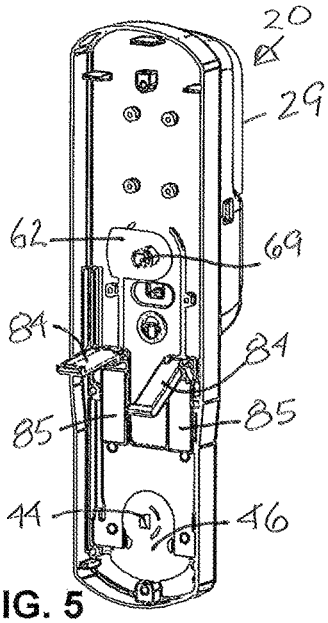

One embodiment of the lock assembly 20 of the present invention is shown in FIGS. 1*a* and 1*b* depicting different offset spacings between a latchbolt 30 and a deadbolt 50 extending from the edge 21*a* of door 21. Door 21 may be manufactured with different spacings 70 between latchbolt bore 34 and deadbolt bore 54, for example, 4 in. (102 mm) as shown in FIG. 1*a* or 5.5 in. (140 mm) as shown in FIG. 1*b*. Latchbolt 30 and deadbolt 50 are moveable along their respective axes 42 and 56 into and out of the door edge from their unlatched or unbolted and latched or bolted positions, respectively. The offset distance 70 is the distance between latchbolt axis 42 and deadbolt axis 56, and corresponds to the spacing between latchbolt bore 34 and deadbolt bore 54. The embodiment of the lock assembly 20, mounted on the inside of the door, employs a manually operated inner latchbolt actuator 36, where a handle extends laterally from and is rotatable about latchbolt actuator driver or shaft 44, and a manually operated deadbolt actuator, where thumbturn 68 is rotatable about deadbolt actuator driver or shaft 69. A deadbolt cover plate 29 receives the deadbolt actuator 68, and may be positioned lower (FIG. 1*a*) or higher (FIG. 1*b*) on the lock assembly front cover plate or escutcheon 22 to cover the areas of the openings through which the deadbolt actuator shaft protrudes at the two different offsets.

On the back surface of front cover plate 22, inside lock assembly 20, are mounted latchbolt mechanism 32, deadbolt lock mechanism 52 and sliding pusher mechanism 80, as seen in FIGS. 2-13 and 16*a*, 16*b* and 16*c*. Latchbolt mechanism 32 includes latchbolt actuator shaft 44 extending from inner handle 36 through latchbolt shaft opening 26 in cover plate 22, and locking into latchbolt cam 46. Latchbolt bore 34 extends perpendicularly from the inner surface of door 21 to its outer surface. Shaft 44 extends beyond cam 46 and engages an otherwise conventional latchbolt lock core (not shown) positioned in bore 34, such as a cylindrical or tubular lock, to move latchbolt 30 between its latched and unlatched positions upon rotation of the inner latchbolt actuator. When inner handle 36 is horizontal and latchbolt actuator shaft 44 is in its default position, latchbolt 30 is in its unretracted, latched position, and when inner handle 36 is rotated, latchbolt 30 moves inward to its retracted, unlatched position.

Cam 46 includes lobes 46*a*, 46*b* extending laterally in opposite directions. Pusher mechanism 80 includes slider 82 which has an "H" shape with a pair of members 82*a*, 82*b* extending upward a first distance, with a slot between them, and a pair of lower members 82*c*, 82*d*. Cam lobe 46*a* is able to bear against the bottom of lower end member 82*d* of slider 82 when inner handle 36 and shaft 44 are rotated in one direction (clockwise), and cam lobe 46*a* is able to bear against the bottom of lower end member 82*d* of slider 82 when inner handle 36 is rotated in the other direction (counterclockwise). In either rotational direction, cam 46 urges slider upward toward deadbolt lock mechanism 52. A cover plate 85 is disposed over the slider.

Figures 10, 11, 12, 13:
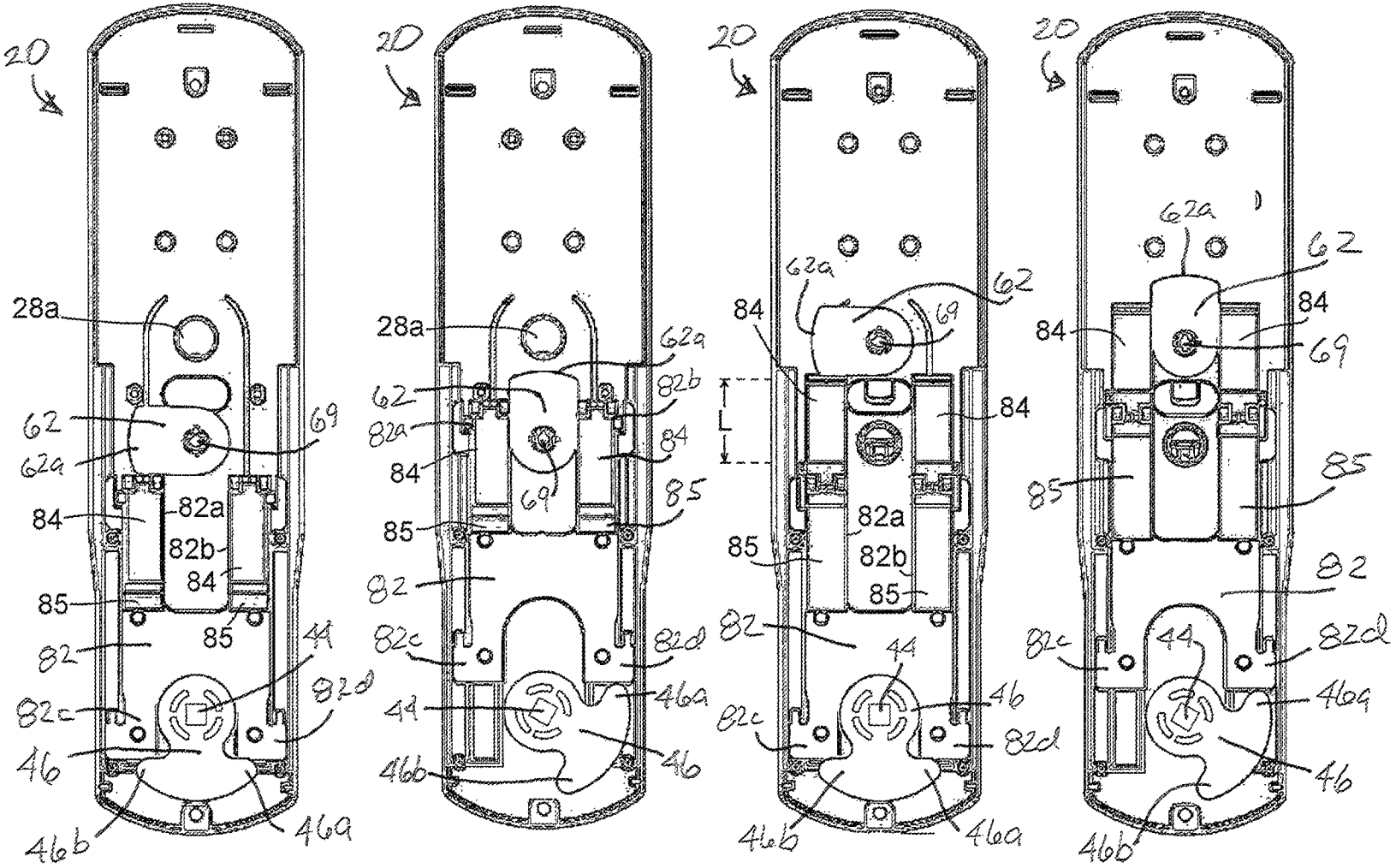
FIG. 10 is a rear elevational view of the lock assembly of FIG. 1*a* showing an embodiment of the pusher mechanism of the present invention in the closer offset spacing position, and in the deadbolt locked position.
FIG. 11 is a rear elevational view of the lock assembly of FIG. 10 showing the deadbolt in the unlocked position.
FIG. 12 is a rear elevational view of the lock assembly of FIG. 1*b* showing the pusher mechanism in the greater offset spacing position, and in the deadbolt locked position.
FIG. 13 is a rear elevational view of the lock assembly of FIG. 12 showing the deadbolt in the unlocked position.
Figure 15:
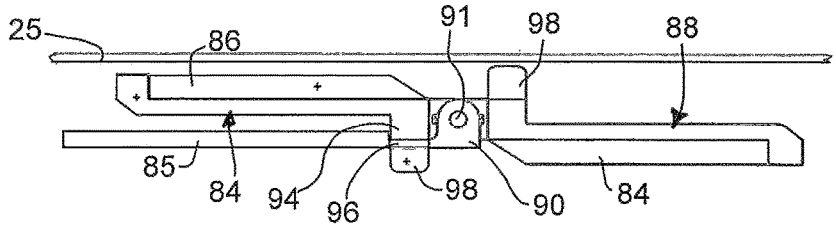
FIG. 15 is a side elevational view of the arm of FIG. 14 in the extended position with respect to the rear plate of the lock assembly.
Figure 14:
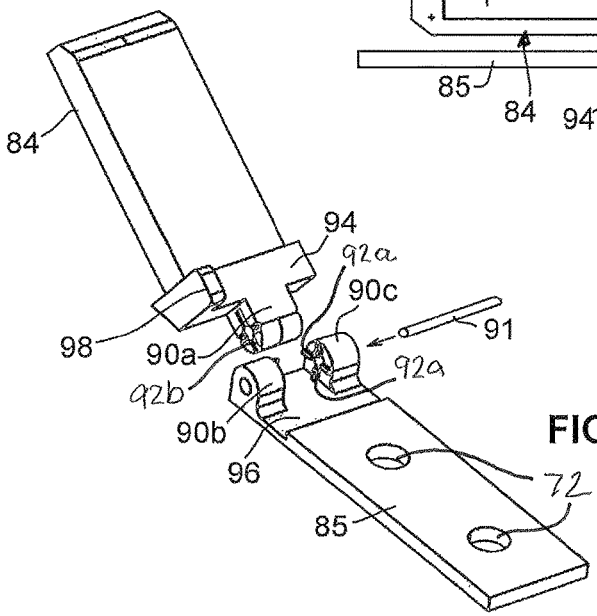
FIG. 14 is perspective exploded view of the folding arm used to extend the pusher mechanism in one embodiment of the present invention.

Deadbolt lock mechanism 52 includes deadbolt actuator shaft 69 extending from thumbturn 68 through deadbolt shaft opening 28*a* or 28*b* in cover plate 22, and locking into deadbolt cam 62. Deadbolt bore 54 extends perpendicularly from the inner surface of door 21 to its outer surface. Shaft 69 extends beyond cam 62 and engages an otherwise conventional security lock (not shown) in bore 54 operated by a key on the outside of the door or thumbturn on the inside of the door to move deadbolt 50 between its latched and unlatched positions upon rotation of the deadbolt actuator shaft. Cam 62 has a projection 62*a* extending away from shaft 69 and is sized to be received in the slot between slider upper members 82*a*, 82*b*. When the deadbolt is in the extended and locked position, projection 62*a* on deadbolt cam 62 is positioned horizontally away from shaft, either to the right or left. Before movement of the latchbolt actuator handle 36, slider 82 is in a lower position in which cam 62 is above the slot between slider upper members 82*a*, 82*b*, and slider 82 is not engaged with or out of contact with the deadbolt actuator cam, as shown in FIG. 10. Upon movement of the slider upward, by rotation of inner latchbolt actuator handle 36 to cause latchbolt cam lobe 46*a* or 46*b* to urge slider 82 upward, slider upper member 82*a* or 82*b* bears against projection 62*a* of the deadbolt cam, and causes the cam to rotate to end up with projection 62*a* in the upper position, as shown in FIG. 11. This rotation of deadbolt cam 62 causes deadbolt 50 to move inward to the unlatched position, at the same time that latchbolt 30 moves inward to the unlatched position. At this point, the user may open the door. After the user is outside and the door is closed, the latchbolt normally returns to the latched position automatically, and the deadbolt may be manually latched by use of a key on a deadbolt security lock or whatever security locking mechanism is employed. It should be noted that operation of the handle on the outer side of the door (not shown) does not rotate cam 36, and the deadbolt may only be retracted from the outside of the door by the key or otherwise unlocking the deadbolt security locking mechanism.

Figures 16A, 16B, 16C:
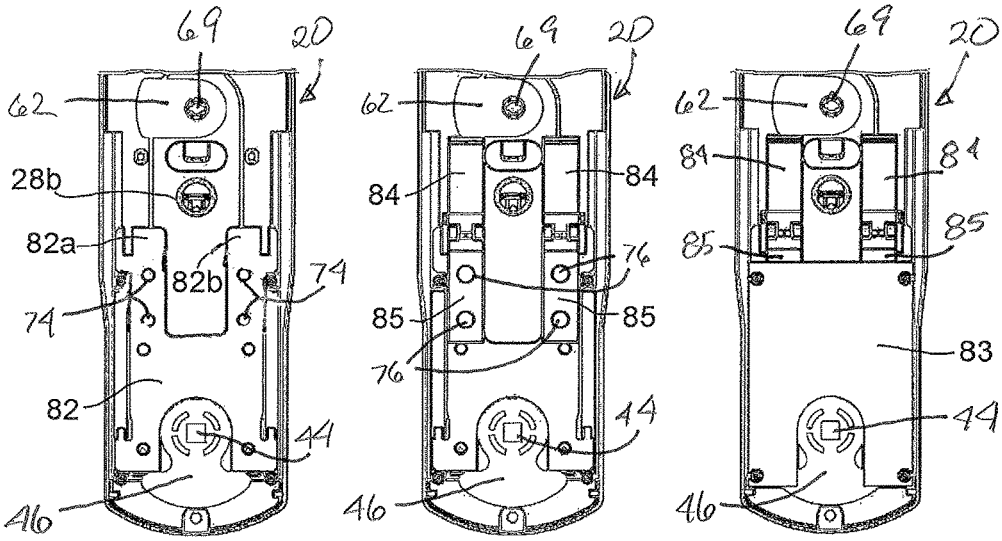
FIGS. 16*a*, 16*b* and 16*c* are rear elevational views of the lock assembly of FIG. 1*b* showing the sequence of assembling the arm of FIG. 14 onto the slide of the pusher mechanism.
Figure 17:
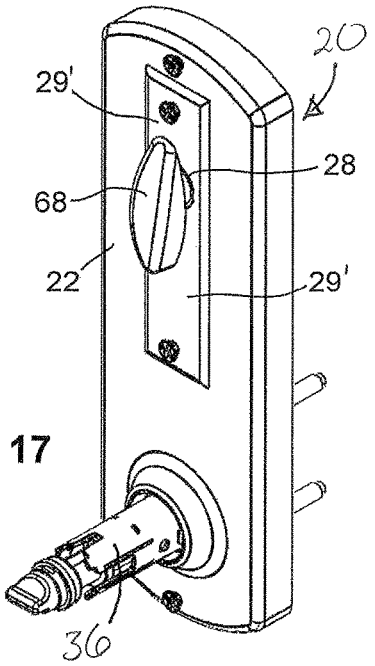
FIG. 17 is a front perspective view of another embodiment of the lock assembly of the present invention, in the greater offset spacing position.

While upper members 82*a*, 82*b* are sufficiently long to cause rotation of deadbolt cam 62 when deadbolt actuator shaft 69 is positioned at cover plate opening 28*b* and offset spacing 70 is at the closer or shorter distance, the members are not long enough to cause rotation of deadbolt cam 62 when deadbolt actuator shaft 69 is positioned at cover plate opening 28*a* and offset spacing 70 is at the longer distance. To enable slider 82 to be extended sufficiently to bear against cam 62 when at the longer offset distance, extendible arms 84 are mounted on upper members 82*a*, 82*b*. As shown in more detail in FIGS. 14 and 15, arm 84 in the embodiment shown is an elongated rectangular member having an end center hinge portion 90*a* which mates via hinge pin 90 with spaced hinge portions 90*b* and 90*c* on an end of rectangular base 85. Base 85 includes openings 72 or other means by which it may be secured by rivets or other fasteners into comparable openings in an upper slider member. The widths and thicknesses of arm 84 and upper slider members 84*a*, 84*b* are comparable and may be approximately the same. FIG. 16*a* shows the openings 74 in slider upper members 82*a*, 82*b*, and FIG. 16*b* shows bases 85 of arms 84 secured over upper members 82*a*, 82*b* by rivets 76 in those openings. FIG. 16*c* shows cover 83 installed over portions of pusher mechanism 80 and latchbolt mechanism 32.

Figure 9:
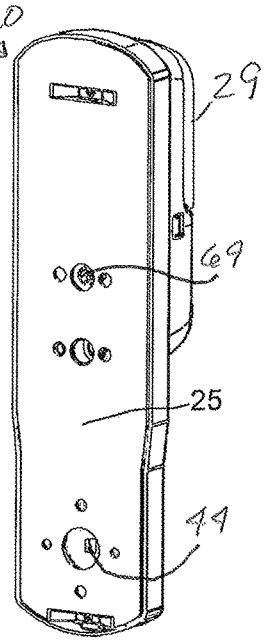
FIG. 9 is a rear perspective view of the lock assembly of FIGS. 4-8 with the rear panel in place after the adjustment of the pusher mechanism to greater offset spacing has been accomplished.

Referring again to FIGS. 14 and 15, the inward faces of base hinge portions 90*b*, 90*c* include detent tabs 92*a* at 0, 90, 180 and 270 degree positions which engage corresponding detent slots 92*b* at 0, 90, 180 and 270 degree positions on either side of mating arm hinge portion 90*a* to provide detent positions to help hold arm 84 either in the retracted position 86 at 0 degree rotation with respect to the base, or the extended position 88 at 180 degree rotation with respect to the base, as shown in FIG. 15. When in the retracted position 86, flange 94 extending out of the plane of arm 84 adjacent the hinge projects into and contacts slot 96 in base 85 adjacent the hinge (FIG. 15) to maintain proper position during movement of the pusher mechanism 80 and slide 82. Back plate 25 of lock assembly 20 contacts the surface of the door and covers substantially the entire back portion of the lock assembly, and protects the latchbolt, pusher and deadbolt mechanisms (FIG. 9). When in the extended position 88, tab 98 extending out of the plane of arm 84 adjacent the hinge and beyond flange 94 toward back plate 25 is slideable along the interior surface of back plate 25 (FIG. 15) to prevent movement of the arm away from the extended position during movement of the pusher mechanism 80 and slide 82.

Figure 4:
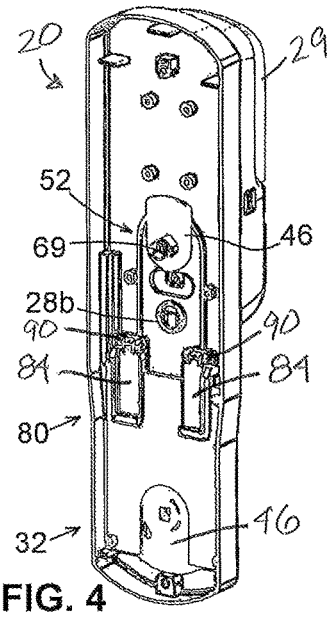
FIGS. 4 through 8 are rear perspective views of the lock assembly of FIG. 1*b* in the greater offset spacing position showing the sequence of extension of one embodiment of the pusher mechanism of the present invention from the closer offset spacing position to the greater offset spacing position.
Figure 6:
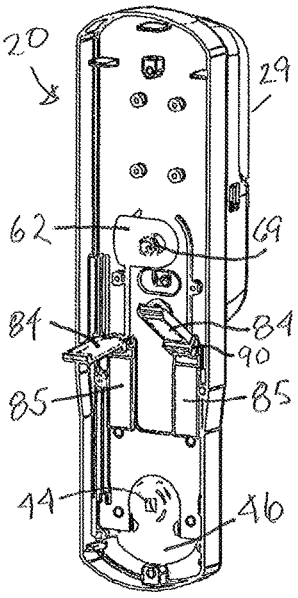
Figure 7:
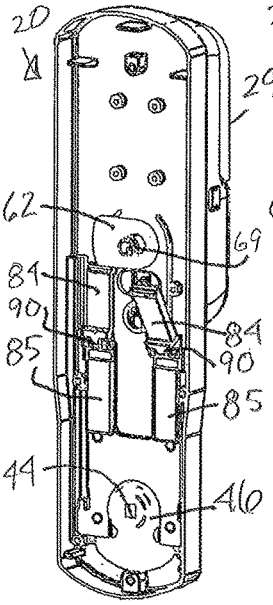
Figure 8:
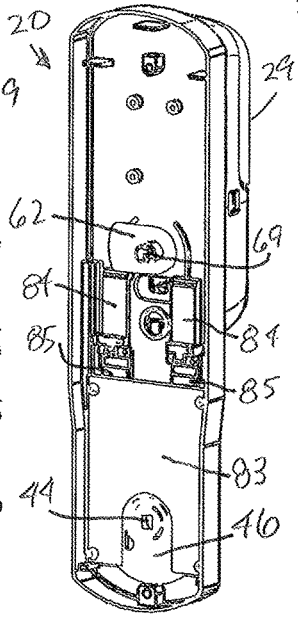

The sequence of causing slider 82 to change from the fully retracted position to the fully extended position is shown in FIGS. 4 through 8. In this example lock assembly 20 is initially in the closer offset distance, e.g., a 4 in. (102 mm) offset between the latchbolt and deadbolt. In this sequence, it is desired to extend the latchbolt-deadbolt offset distance to the greater offset, e.g., 5.5 in. (140 mm). Initially, the deadbolt shaft 69 and deadbolt cam 46 are repositioned from cover plate opening 28*b* to opening 28*a*, as shown in FIG. 4. From the fully retracted position in FIG. 4 (normally used for the closer offset distance), arms 84 are first pulled away from their respective bases 85, as shown in FIGS. 5 and 6, and then fully extended 180 degrees from the bases as shown for the right arm in FIG. 7, and for both arms in FIG. 8. Cover 83 is installed over portions of pusher mechanism, as shown in FIG. 8, and rear cover plate 25 is then secured over the back of the lock assembly, as shown in FIG. 9. The lock assembly 20 is then ready to be mounted to the interior door surface.

Operation of the extended pusher mechanism 80 and slider 82 is shown in FIGS. 12 and 13. As before, when the deadbolt is in the extended and locked position, projection 62*a* on deadbolt cam 62 is positioned horizontally away from shaft, to the left as shown in FIG. 12. Before movement of the latchbolt actuator handle 36, slider 82 is in a lower position in which cam 46 is above the slot between slider extended arms 84 and slider 82 is out of contact with the deadbolt actuator cam. Arms 84 in the extended position cause slide 82 to have a length greater than the length of the upper members 82*a*, 82*b*, alone. The length L of each extendable arm 84 above the top of the slider upper member may be approximately the difference of the distance between the two offset spacings, e.g., 1.5 in. (38 mm). Upon movement of the slider upward by action of cam 46, slider extended arm 84 on the left bears against projection 62*a* of the deadbolt cam, and causes the cam to rotate to end up with projection 62*a* in the upper position, as shown in FIG. 13, and which causes deadbolt 50 to move inward to the unlatched position, again at the same time that latchbolt 30 moves inward to the unlatched position.

Figure 18:
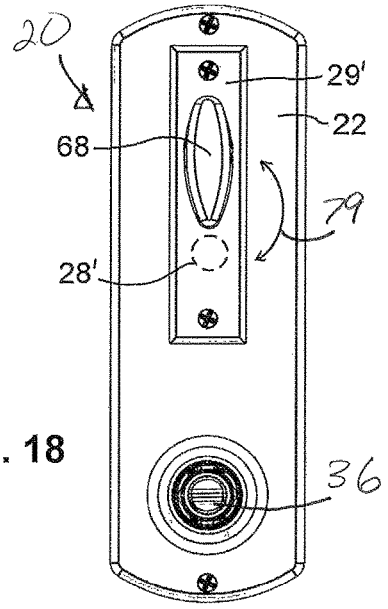
FIG. 18 is front elevational view of the lock assembly of FIG. 17.
Figure 19:
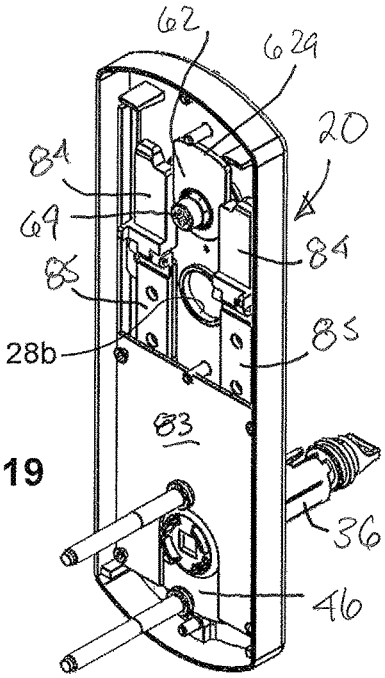
FIG. 19 is a rear perspective view of the lock assembly of FIG. 17.
Figure 20:
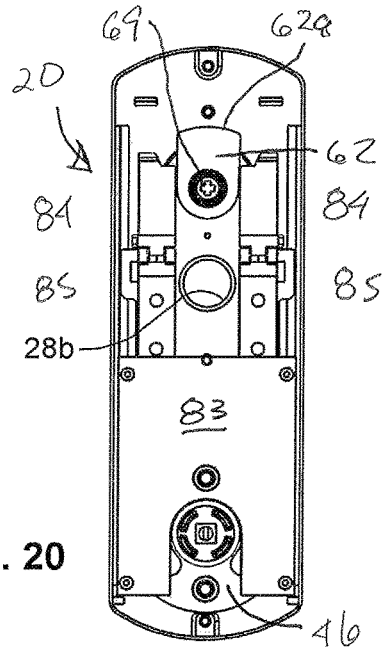
FIG. 20 is a rear elevational view of the lock assembly of FIG. 17.

Instead of the sliding repositioning of deadbolt cover plate 29 as previously shown in FIGS. 1*a* and 1*b*, FIGS. 17-20 shown another embodiment of the cover plate. Deadbolt cover plate 29' fits within a recess in lock front plate 22 and has deadbolt actuator shaft opening 28 closer to one end thereof, the upper end as shown, when the latchbolt-deadbolt offset is the greater distance. As part of the adjustment of lock assembly 20 to a closer latchbolt-deadbolt offset distance, thumbturn 68 and shaft 69 are removed from the lock assembly, and deadbolt cover plate 29' would be rotated 180 degrees as shown by arrow 79 to align the deadbolt actuator shaft opening to new position 28' closer to the lower end, as shown in FIG. 18. Readjustment of the pusher mechanism for the deadbolt cam is as described previously, and arms 84 are flipped downward from their extended positions as shown in FIGS. 19 and 20, to retracted positions (see FIGS. 10 and 11).

In the method of operation in the interconnected lock of the present invention, the user adjusts the spacing between the latchbolt first axis and the deadbolt second axis to change the offset spacing between the deadbolt and latchbolt to a shorter or longer offset spacing distance. If changing to a shorter offset spacing distance, the user reduces extension of the pusher mechanism to the shorter length, for example by folding arm 84 down against arm base 85. If changing to a longer offset spacing distance, the user extends the pusher mechanism to the longer length, for example by unfolding arm 84 away from arm base 85.

In the present invention, a single design configuration accommodates both a 4 in. (102 mm) and a 5.5 in. (140 mm) positional orientation by using an internal pusher mechanism component that can be altered in length. An adjustable length enables engagement of the pusher component with the thumbturn lifter, i.e., deadbolt cam at the two alternative positions.

While the drawings show a slider extendable by a hinged arm to move the deadbolt cam in the greater offset distance, other methods of extending slider upper members may be employed. For example, the slider may have an arm that is initially positioned parallel to and alongside one or both of the upper members for the closer offset distance, but may be slidingly engaged thereto to slide upward to an extended position of sufficient length to engage the deadbolt cam when at the longer offset distance.

The present invention achieves product adjustability with relative ease for the installer. Product assembly comes pre-set in one position, e.g., a 4 in. (102 mm) or 5.5 in. (140 mm) center-to-center orientation. An unfolding or folding over action of a hinged pusher component is provided so that the product can be adapted to the opposite 5.5 in. (140 mm) or 4 in. (102 mm) center-to-center orientation.

Accordingly, the present invention provides an interconnected lock that is able to switch between different latchbolt-deadbolt offset spacings without any disassembly of the assembly that operates the deadbolt, either partially or completely. The interconnected lock of the present invention is able to switch between different latchbolt-deadbolt offset spacings without adding or removing any components thereof. The interconnected lock of the invention may be switched between different latchbolt-deadbolt offset spacings without the potential of losing parts during the spacing adjustment. Additionally, the interconnected lock of the present invention is able to accomplish the switch between different latchbolt-deadbolt spacings without the need for using any tools. The pusher mechanism adjustment design configuration is an ergonomic and intuitively adjustable solution for the installer and cost effective for the manufacturer. Since no disassembly is required, installation time is reduced.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. An interconnected lock for use on a door, the lock having adjustable offset spacing between a deadbolt and latchbolt, comprising:

a latchbolt mechanism mountable in a first bore through a door, the latchbolt lock mechanism including a latchbolt and an interior actuator operable to move the latchbolt between latched and unlatched positions along a first axis;

a deadbolt lock mechanism mountable in a second bore through the door, the second bore being spaced from the first bore, the deadbolt lock mechanism including a deadbolt moveable by the deadbolt lock mechanism along a second axis between latched and unlatched positions, distance between the latchbolt first axis and the deadbolt second axis being the offset spacing; and a sliding pusher mechanism between the latchbolt mechanism and the deadbolt lock mechanism, the pusher mechanism having at least one arm operable upon operation of the interior actuator to bear against the deadbolt lock mechanism and move the deadbolt along the second axis from the latched to the unlatched position at the same time that the operation of the interior actuator moves the latchbolt along the first axis from the latched to the unlatched position, the pusher mechanism arm being extendable between a first length and a second, longer length when adjusting spacing between the first and second axes to change offset spacing between the deadbolt and latchbolt between a first distance and a second, longer distance;

wherein the pusher mechanism arm is connected by a hinge to the pusher mechanism, the arm being movable about the hinge between a retracted position wherein the pusher mechanism arm does not bear against the deadlock bolt mechanism, and an extended position wherein the pusher mechanism arm bears against the deadbolt lock mechanism.

2. The interconnected lock of claim 1 wherein the deadbolt lock mechanism includes a deadbolt cam, and wherein the pusher mechanism arm bears against the deadbolt cam to rotate the cam and move the deadbolt from the latched to the unlatched position.

3. The interconnected lock of claim 1 wherein the deadbolt lock mechanism includes a deadbolt cam, and wherein the pusher mechanism arm in the extended position bears against the deadbolt cam to rotate the cam and move the deadbolt from the latched to the unlatched position.

4. The interconnected lock of claim 1 wherein the at least one arm is movable about the hinge between a retracted position folded against the pusher mechanism wherein the pusher mechanism arm does not bear against the deadbolt lock mechanism and an extended position away from the pusher mechanism wherein the pusher mechanism arm bears against the deadbolt lock mechanism.

5. The interconnected lock of claim 4 wherein the hinge includes a detent to hold the at least one arm in either the retracted position or the extended position.

6. The interconnected lock of claim 4 wherein the at least one arm includes a flange or slot and wherein when the at least one arm is in the folded position the flange or slot contacts a slot or flange in the pusher mechanism to maintain position of the at least one arm during movement of the pusher mechanism.

7. The interconnected lock of claim 1 further comprising a plate covering the pusher mechanism, and wherein the at least one arm includes a tab extending toward the plate when the at least one arm is in the extended position, the tab being slideable along the plate to prevent movement of the at least one arm away from the extended position during movement of the pusher mechanism.

8. The interconnected lock of claim 1 wherein the latchbolt mechanism includes an actuator cam operable by the interior actuator to slide the pusher mechanism and at least one arm against the deadbolt cam.

9. The interconnected lock of claim 1 comprising a pair of arms, each connected by a hinge to the pusher mechanism and movable about the hinge between the retracted position and extended positions.

10. An interconnected lock for use on a door, the lock having adjustable offset spacing between a deadbolt and latchbolt, comprising:

a latchbolt mechanism including a latchbolt and an interior actuator operable to move the latchbolt between latched and unlatched positions along a first axis;

a deadbolt lock mechanism spaced from the latchbolt mechanism and including a deadbolt moveable by the deadbolt lock mechanism along a second axis between latched and unlatched positions, distance between the latchbolt first axis and the deadbolt second axis being the offset spacing;

a sliding pusher mechanism between the latchbolt mechanism and the deadbolt lock mechanism, the pusher mechanism operable upon operation of the interior actuator to bear against the deadbolt lock mechanism and move the deadbolt along the second axis from the latched to the unlatched position at the same time that the operation of the interior actuator moves the latchbolt along the first axis from the latched to the unlatched position, the pusher mechanism including an arm that may bear against the deadbolt lock mechanism and may be retracted and extended about a hinge between a first length and a second, longer length when adjusting spacing between the first and second axes to change offset spacing between the deadbolt and latchbolt between a first distance and a second, longer distance, the arm being extendable from the first length to the second length without adding or removing any components thereof.

11. A method of adjusting offset spacing between a deadbolt and latchbolt in interconnected lock for use on a door, the method comprising:

providing a lock having latchbolt mechanism mountable in a first bore through a door, the latchbolt mechanism including a latchbolt and an interior actuator operable to move the latchbolt between latched and unlatched positions along a first axis; a deadbolt lock mechanism mountable in a second bore through the door, the second bore being spaced from the first bore, the deadbolt lock mechanism including a deadbolt moveable by the deadbolt lock mechanism along a second axis between latched and unlatched positions, distance between the latchbolt first axis and the deadbolt second axis being the offset spacing; and a sliding pusher mechanism between the latchbolt mechanism and the deadbolt lock mechanism, the sliding pusher mechanism having at least one arm; the pusher mechanism operable upon operation of the interior actuator to bear against the deadbolt lock mechanism and move the deadbolt along the second axis from the latched to the unlatched position at the same time that the operation of the interior actuator moves the latchbolt along the first axis from the latched to the unlatched position, the at least one pusher mechanism arm being extendable between a first length and a second, longer length; the offset spacing distance between the latchbolt first axis and the deadbolt second axis being set at a predetermined offset spacing distance;

adjusting the spacing between the latchbolt first axis and the deadbolt second axis to change the offset spacing between the deadbolt and latchbolt to a shorter or longer offset spacing distance;

if changing to a shorter offset spacing distance, reducing extension of the pusher mechanism to the first length; and if changing to a longer offset spacing distance, extending the pusher mechanism to the second length, whereby the reduction or extension of the length of the pusher mechanism is accomplished without adding or removing any components thereof;

wherein reducing extension of the pusher mechanism to the first length is accomplished by moving the arm about a hinge to a retracted position and wherein extending the pusher mechanism to the second length is accomplished by moving the arm to an extended position.

12. The method of claim 11 wherein reducing extension of the pusher mechanism arm to the first length or extending the pusher mechanism arm to the second length is by moving the arm.

13. The method of claim 11 wherein the pusher mechanism arm is connected by a hinge to the pusher mechanism, and wherein reducing extension of the pusher mechanism arm to the first length is by moving the arm about the hinge to a retracted position and wherein extending the pusher mechanism arm to the second length is by moving the arm to an extended position.

14. The method of claim 13 wherein the pusher mechanism arm is movable about the hinge between the retracted position folded against the pusher mechanism wherein the pusher mechanism arm does not bear against the deadbolt mechanism and the extended position away from the pusher mechanism wherein the pusher mechanism arm bears against the deadbolt mechanism.

15. The method of claim 13 wherein the hinge includes a detent and wherein reducing extension of the pusher mechanism arm to the first length or extending the pusher mechanism arm to the second length engages the detent to hold the at least one arm in either the retracted position or the extended position.

16. The method of claim 14 wherein the at least one arm includes a flange or slot and wherein when the at least one arm is in the folded position the flange or slot contacts a slot or flange in the pusher mechanism to maintain position of the at least one arm during movement of the pusher mechanism.

17. The method of claim 14 wherein the lock further includes a plate covering the pusher mechanism, and wherein the at least one arm includes a tab extending toward the plate when the at least one arm is in the extended position, the tab being slideable along the plate to prevent movement of the at least one arm away from the extended position during movement of the pusher mechanism.

18. The method of claim 11 whereby the reduction or extension of the length of the pusher mechanism arm is accomplished without any disassembly of the pusher mechanism.

19. An interconnected lock for use on a door, the lock having adjustable offset spacing between a deadbolt and latchbolt, comprising:

a latchbolt mechanism mountable in a first bore through a door, the latchbolt lock mechanism including a latchbolt and an interior actuator operable to move the latchbolt between latched and unlatched positions along a first axis;

a deadbolt lock mechanism mountable in a second bore through the door, the second bore being spaced from the first bore, the deadbolt lock mechanism including a deadbolt moveable by the deadbolt lock mechanism along a second axis between latched and unlatched positions, distance between the latchbolt first axis and the deadbolt second axis being the offset spacing; and a sliding pusher mechanism between the latchbolt mechanism and the deadbolt lock mechanism, the pusher mechanism operable upon operation of the interior actuator to bear against the deadbolt lock mechanism and move the deadbolt along the second axis from the latched to the unlatched position at the same time that the operation of the interior actuator moves the latchbolt along the first axis from the latched to the unlatched position, the pusher mechanism being extendable between a first length and a second, longer length when adjusting spacing between the first and second axes to change offset spacing between the deadbolt and latchbolt between a first distance and a second, longer distance;

wherein the pusher mechanism includes at least one arm connected by a hinge to the pusher mechanism, the arm being movable about the hinge between a retracted position and an extended position.

20. An interconnected lock for use on a door, the lock having adjustable offset spacing between a deadbolt and latchbolt, comprising:

a latchbolt mechanism mountable in a first bore through the door, the latchbolt lock mechanism including a latchbolt and an interior actuator operable to move the latchbolt between latched and unlatched positions along a first axis;

a deadbolt lock mechanism mountable in a second bore through the door, the second bore being spaced from the first bore, the deadbolt lock mechanism including a deadbolt moveable by the deadbolt lock mechanism along a second axis between latched and unlatched positions, distance between the latchbolt first axis and the deadbolt second axis being the offset spacing;

a sliding pusher mechanism between the latchbolt mechanism and the deadbolt lock mechanism, the pusher mechanism operable upon operation of the interior actuator to bear against the deadbolt lock mechanism and move the deadbolt along the second axis from the latched to the unlatched position at the same time that the operation of the interior actuator moves the latchbolt along the first axis from the latched to the unlatched position, the pusher mechanism being extendable between a first length and a second, longer length when adjusting spacing between the first and second axes to change offset spacing between the deadbolt and latchbolt between a first distance and a second, longer distance, wherein the pusher mechanism may be extended from the first length to a second, longer length without any disassembly of the pusher mechanism.

21. An interconnected lock for use on a door, the lock having adjustable offset spacing between a deadbolt and latchbolt, comprising:

a latchbolt mechanism mountable in a first bore through the door, the latchbolt lock mechanism including a latchbolt and an interior actuator operable to move the latchbolt between latched and unlatched positions along a first axis;

a deadbolt lock mechanism mountable in a second bore through the door, the second bore being spaced from the first bore, the deadbolt lock mechanism including a deadbolt moveable by the deadbolt lock mechanism along a second axis between latched and unlatched positions, distance between the latchbolt first axis and the deadbolt second axis being the offset spacing;

a sliding pusher mechanism between the latchbolt mechanism and the deadbolt lock mechanism, the pusher mechanism operable upon operation of the interior actuator to bear against the deadbolt lock mechanism and move the deadbolt along the second axis from the latched to the unlatched position at the same time that the operation of the interior actuator moves the latchbolt along the first axis from the latched to the unlatched position, the pusher mechanism being extendable between a first length and a second, longer length when adjusting spacing between the first and second axes to change offset spacing between the deadbolt and latchbolt between a first distance and a second, longer distance, wherein the pusher mechanism may be extended from the first length to a second, longer length without the use of any tools.

* * * * *